United States Patent [19]

Schaffer

[11] 4,152,109

[45] May 1, 1979

[54] COMBINATION POCKET LIGHTER AND TAMPER

[76] Inventor: Lyle E. Schaffer, Butterfield La., Flossmoor, Ill. 60422

[21] Appl. No.: 914,662

[22] Filed: Jun. 12, 1978

Related U.S. Application Data

[63] Continuation-in-part of Ser. No. 804,912, Jun. 9, 1977, abandoned.

[51] Int. Cl.[2] ..... A24F 9/02

[52] U.S. Cl. ..... 431/253; 131/243; 131/247

[58] Field of Search ..... 431/253, 344, 135; 131/243, 247

[56] References Cited

U.S. PATENT DOCUMENTS

| | | | |
|---|---|---|---|
| 3,220,420 | 11/1965 | Genoud | 431/353 X |
| 3,777,766 | 12/1973 | Kanady | 131/243 |
| 4,043,348 | 8/1977 | Kanady | 131/243 |

*Primary Examiner*—Edward G. Favors

*Attorney, Agent, or Firm*—Neuman, Williams, Anderson & Olson

[57] ABSTRACT

This combination comprises a pyrophoric lighter having cover means for the lighter mechanism and a tamper device housed entirely within the cover means when the latter is in the closed position. Both the lighter mechanism and tamper device are conveniently exposed in an operative position by simply opening the cover means in a single motion. The tamper mechanism is controlled by the means for biasing the cover means in the closed position or holding it in the open position. The preferred embodiment of the combination is in the form of a pocket lighter which may be advantageously employed for both tamping pipe tobacco and lighting the same.

7 Claims, 10 Drawing Figures

FIG. 7
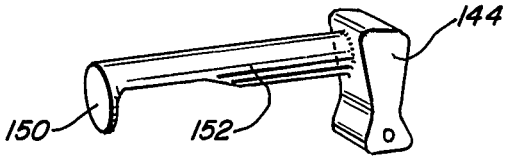
FIG. 6
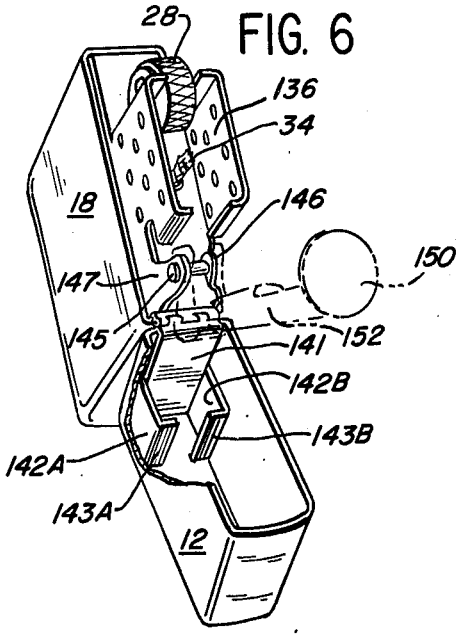
FIG. 8
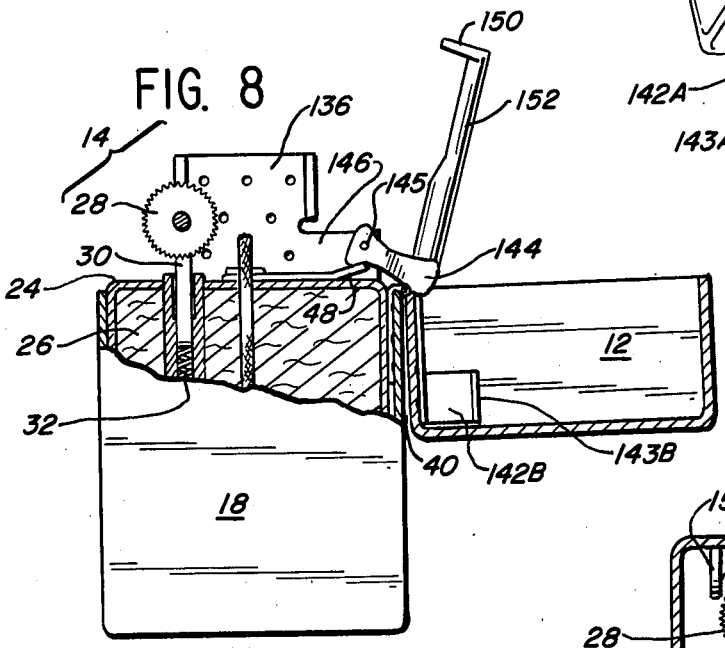
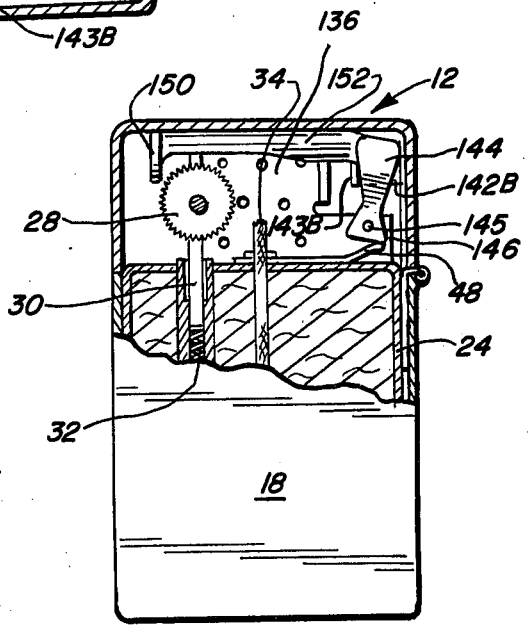
FIG. 9
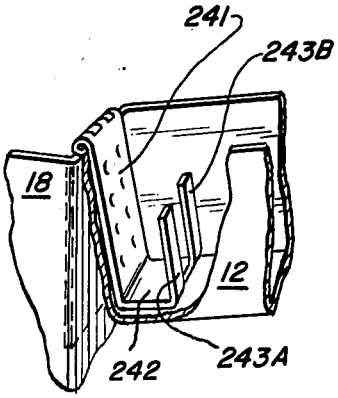
FIG. 10

COMBINATION POCKET LIGHTER AND TAMPER

RELATED CASE

This application is a continuation-in-part of my application Ser. No. 804,912, filed June, 9, 1977, allowed Mar. 30, 1978, now abandoned.

BACKGROUND OF THE INVENTION

1. Field of the Invention

This invention relates to pyrophoric devices such as pocket lighters which are employed in connection with smoking tobacco. More specifically, in a particular embodiment it relates to a combination lighter and pipe tobacco tamper which is completely enclosed for carrying and storage purposes and is readily opened with a single motion so that the lighter mechanism and the tamper may be selectively employed.

While the present invention is described herein in connection with a specific embodiment, it should be understood that the invention is not necessarily limited thereto. The inventive concept set forth herein can be readily adapted as an improved combination with other lighter mechanisms.

2. Description of the Prior Art

The need for a combination of lighter and tobacco handling device has long been recognized and is reflected, for example, in many issued patents, e.g., U.S. Pat. Nos. 544,691, 610,142, 2,719,526, 2,894,515, 3,220,420, 3,777,766 and 4,043,348. The devices shown in these patents include combination pocket lighters and tampers, picks or cutters but otherwise suffer from one or more shortcomings.

For example, none of them is compatible with presently existing lighter designs which already have received wide acceptance. The prior art devices are essentially designed and fabricated as unique devices which differ in appearance from conventional lighters and lack commonality of parts. This is reflected in higher manufacturing costs, and market acceptance and familiarity of the user must be cultivated.

Moreover, the prior art devices are not as safe or sanitary or otherwise as aesthetic as desired. Even when the tamping mechanism is in the stored position, it is often externally exposed along with any entrained tobacco or residues. The latter may be deposited in the clothing of the user, leading to undesired soilage, odors or the like. The exposed parts may puncture or snag on clothing and may make the carrying of the device quite uncomfortable, unsightly or inconvenient.

Furthermore, if the tamping mechanism becomes heated as a result of contact with burning tobacco, the mechanism can cause injury or discomfiture to the user or damage to his clothing. In addition, the unsightly tobacco shreds, dried juices, tars and the like which accumulate over a period of usage present a very unsightly appearance to both the user and observer.

Still further, some of the prior art devices are inconvenient to use. Certain devices require several steps to actuate or require two-handed manipulation. The user must also bring his fingers in contact with the tamper, an uninviting prospect at best.

The present invention is directed to the solution of these and other problems associated with prior art devices, as reflected in the following objects.

OBJECTS OF THE INVENTION

It is therefore a general object of the present invention to provide an improved combination lighter and tamping device for use with tobacco products. It is another general object to provide a low-cost combination lighter and tamper which, in external appearance, is the same as prior art lighters already popularly accepted. It is another object to provide a combination lighter and tamper, the lighter portion of which is not substantially changed in design from prior art devices and can be economically fabricated employing many of the same parts.

It is another object to provide a combination lighter and tamper which is safe, clean and aesthetic and does not require that the user touch the tamping device when in use or when storing or unstoring the same. It is another object to provide a combination lighter and tamper wherein both the lighter and tamping mechanisms are completely housed or enclosed when not in use and yet may quickly and conveniently be exposed for use by a single one-handed motion.

It is still another object to provide a low-cost, all-in-one lighter and tamper combination which can be comfortably carried on the person when not in use without fear of clothing soilage or damage or unappealing appearance or odors. These and other objects will become apparent as the description of the invention proceeds.

SUMMARY OF THE INVENTION

These objects are achieved by utilizing the cover control mechanism typically found in normally-covered pyrophoric lighters to bias the cover to a closed position when the lighter is not being used or to hold the cover open when the lighter is being used. The cover control mechanism comprises a spring-biased, pivotally-mounted lever which is biased to a first position or a second position, depending upon the spring follower surface. The lever operatively engages the cover to hold it in the closed or open position corresponding respectively to the first or second positions of the lever. In the improved combination, a tamper means is combined with the lever means so that the lever not only controls the position of the cover but also the disposition of the tamper means when the cover is either open or closed.

The tamper means typically comprises a tamping head on one extremity of an elongated support member, which in turn is secured adjacent the other extremity to said lever means. The head and elongated support member of the tamping means are secured to the lever and disposed so as to be completely enclosed within the cover of the lighter when the lever means is in the first biased or closed position, and to be exposed for tamping purposes when the lever means is in the second biased or open position.

The unique combination of the present invention will be more apparent from a consideration of the drawings.

BRIEF DESCRIPTION OF THE DRAWINGS

The present invention will be more clearly understood from the following detailed description of specific and preferred embodiments, read in conjunction with the accompanying drawings, wherein:

FIG. 6 is a perspective view showing an alternative embodiment of the lighter and tamper combination of the present invention, the tamper mechanism and the spring-biased lever to which it is attached being shown in phantom lines in order to reveal the underlying structure;

FIG. 7 is a slightly-enlarged perspective view of the integrally-formed tamper mechanism and lever shown in phantom lines in FIG. 6;

FIG. 8 is a partially broken away section view of the embodiment of FIG. 6, showing the lighter and tamper mechanisms with the cover disposed in the open position;

FIG. 9 is a partially broken away section view similar to that of FIG. 8 except that the cover is disposed in the closed position; and FIG. 10 is a slightly enlarged, partially broken away fragmentary perspective view of the hinged area of the body and cover showing an alternative embodiment of the inner wall structure of the cover which may advantageously be substituted for that shown in FIGS. 6, 8 and 9.

It should be understood that the drawings are not necessarily to scale and that details which are not necessary to a full understanding of the present invention may not be set forth in the following description. For example, the basic structure of the lighter portion of the combination is the well-known "Zippo" brand lighter, the trademark and product of Zippo Manufacturing Company, Bradford, Pa. The principle of the operation of the Zippo brand lighters is already fully described in the patent literature and need not be repeated here, e.g., U.S. Pat. Nos. 2,032,695 and 2,517,191. As aforementioned, it should also be understood that the invention is not necessarily limited to the specific embodiment illustrated.

DETAILED DESCRIPTION OF THE DRAWINGS, INCLUDING PREFERRED EMBODIMENT

Figure 1:
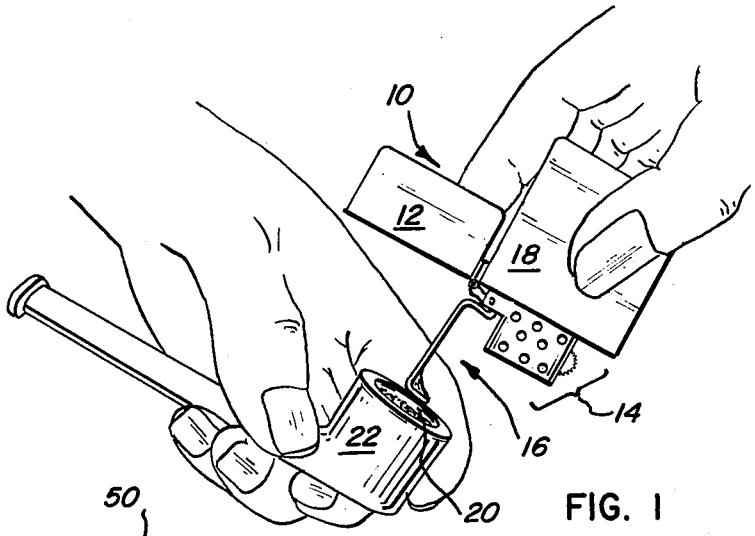
FIG. 1 is a perspective view showing an embodiment of the lighter and tamper combination of the present invention being employed for tamping tobacco in a conventional pipe.

Referring to FIG. 1, the improved lighter and tamper combination 10 of the present invention is shown with the cover 12 in the open position so as to expose the lighter mechanism 14 and tamper mechanism 16 above body member 18. In this position the tamper can be conveniently employed for tamping tobacco in the bowl portion 20 of pipe 22.

Figure 2:
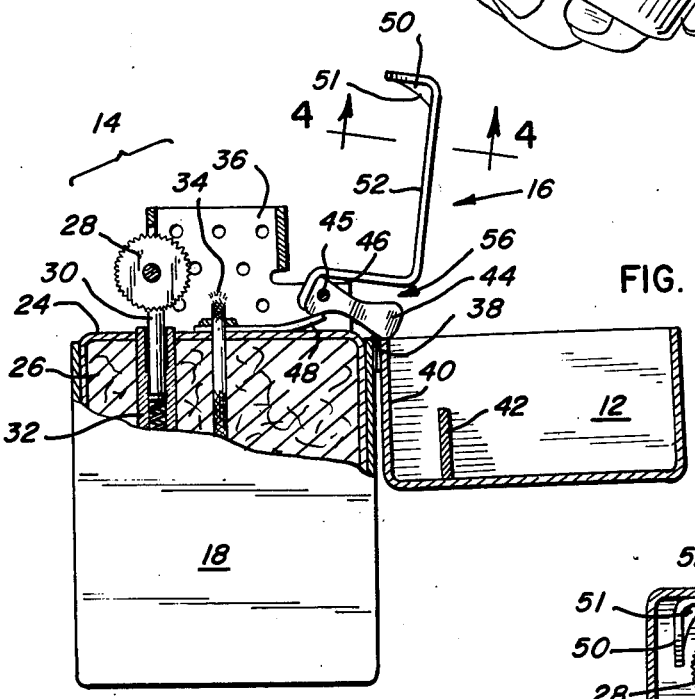
FIG. 2 is an enlarged partially broken away section view of the lighter and tamper combination of FIG. 1 showing the lighter and tamper mechanisms with the cover disposed in the open position.

Referring to FIG. 2, it is apparent that body member 18 is actually the exterior portion of two close-fitting, telescopically-disposed hollow members, the inner member being 24. Since outer member 18 is closed at the bottom and inner member 24 is closed at the top, the resulting internal chamber serves as a reservoir for the inflammable lighter fluid which is carried by a stuffing of saturated cotton waste 26 or the like. Toothed wheel 28 engages the upper end of the elongated flint 30 which is spring-biased thereagainst by spring 32. The sparks resulting from the rotation of wheel 28 ignite the volatile lighter fluid in wick 34, the lower portion of which projects through an aperture in the upper surface of inner hollow member 24 into the fuel reservoir. The resulting flame is protected by windscreen 36 which may be an extension of the side walls of inner hollow member 24.

Cover 12 is hinged to the upper wall of outer hollow member 18 by means of hinge 38. When cover 12 is rotated around hinge 38 towards the closed position, the inner pocket formed by side wall 40 of the cover and inner partial wall 42 engage hour-glass-shaped lever 44 which is pivotally mounted at pin 45 on opposed, matching lugs extending from windscreen 36, only one of the lugs 46 being shown in the section view depicted herein. When cover 12 is swung to the closed position, lever 44 is rotated from the substantially horizontal position shown in FIG. 2 to a substantially upright position depicted in FIG. 3. The lower inner surface of lever 44 acts as a cam and bears against the free end of leaf spring 48 whereby the contacting or mating surfaces of the lever and leaf spring coact so as to bias lever 44 in either of the two positions depicted in FIGS. 2 and 3. The particular position of biasing depends, of course, on which side of the high point of the cam surface of lever 44 is in contact with leaf spring 48.

It will be apparent from a consideration of the geometry of the cam surface and the position of the leaf spring that in FIG. 2 the outer opposite extremity of lever 44 retains cover 12 open so that it can fully swing to the side and expose the lighter mechanism 14 as well as the tamper mechanism 16. When the cover is swung closed against the bias of leaf spring 48, as exerted through lever 44, the over-center point is reached on the contacting surfaces of the leaf spring and lever 44 whereby the cover is snapped shut and is retained shut by the bias exerted by the upper portion of lever 44 against inner partial wall 42 in cover 12.

Figure 4:
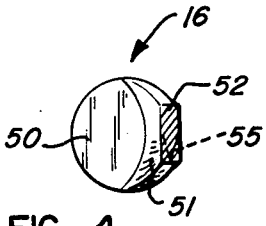
FIG. 4 is a section view on an enlarged scale of the tamper mechanism taken on line 4—4 of FIG. 2.
Figure 3:
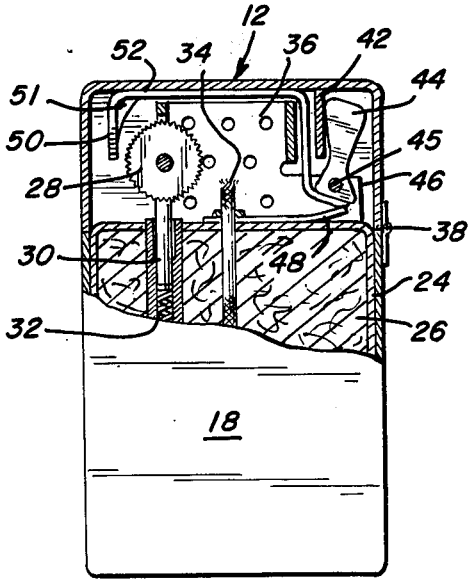
FIG. 3 is a partially broken away section view similar to that of FIG. 2 except that the cover is disposed in the closed position so as to enclose both the lighter and tamper mechanisms.
Figure 5:
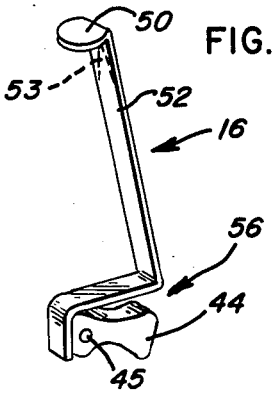
FIG. 5 is a perspective view of the tamper and lever means for controlling the mechanisms, showing the relationship of the two.

Tamper mechanism 16 is secured at its lower extremity to the inner surface of lever 44, as depicted in FIGS. 2 and 3. Referring to FIGS. 4 and 5, tamper mechanism 16 comprises head 50 and support member 52 which, as aforementioned, is secured at its lower extremity to lever 44. As depicted in the drawings, the lower extremity is brazed or welded to the inner surface of lever 44, but may otherwise be secured thereto, e.g., adhered thereto, held thereon by screw-in fasteners or the like. Lever 44 and support member 52 may also be integrally formed. In the embodiment depicted, the lower extremity of support member 52 acts as part of the cam surface contacting leaf spring 48.

While head 50 is depicted as circular, it may have any shape, including any curvilinear or rectilinear configuration. Head 50 may also be simply a pointed end of support member 52 if a pick-like device, rather than tamping device, is desired. This is suggested by dashed lines 53 in FIG. 5. Other alternative embodiments will be apparent to those skilled in the art in the light of this disclosure, and thus the term "head" should be broadly construed.

As indicated in the drawings, head 50 may be integrally formed with support member 52 or may be secured thereto by conventional means, e.g., brazing. It may optionally have a support bead or fillet 51 to provide desired stiffness or rigidity.

Support member 52 is configured and disposed so that when the cover 12 is swung from the open to the closed position, partial wall 42 enters the space 56 between support member 52 and lever 44. Support member 52 is optionally fabricated from spring steel so that it can flex slightly when the cover is closed, if necessary. Thus tolerances are not critical. While support member 52 is shown as having a rectangular cross section in FIG. 4, it may have various other constant or varying cross sections throughout its length. It may also have one side (or both sides) tapered and sharpened to form a cutting blade for clipping off the ends of cigars, cleaning pipe bowls, etc., as suggested by dashed lines 55. Head 50 may be configured and oriented so as not to interfere with the cutting action.

When cover 12 is in the open position, tamper 16 is held by the bias of lever 44 in the position depicted in FIG. 2. At the same time cover 12 is free to swing to the fully open position and, together with body member 18, provides a firm hand grip during the tamping operation, as depicted in FIG. 1. It is also apparent that as cover 12 is closed, it will swing through a substantial arc before lever 44 and the tamper mechanism 16 moves. Thus when cover 12 is moved substantially to the upright position it encloses tamper mechanism 16. Once the tamper mechanism is enclosed within the cover, the second half of the rotation to the closed position results in the disposition depicted in FIG. 3.

Because of the spaced relationship of the hinge points for cover 12 and lever 44, i.e., hinge 38 and pin 45, respectively, tamper mechanism 16 will enter cover 12 only when it is in the upright position of FIG. 2. If the tamper mechanism 16 and lever 44 were to be rotated as a unit to the position depicted in FIG. 3 without rotating cover 12 at the same time, cover 12 could not thereafter be closed. The lower outer edge thereof would strike the upper surface of the tamper support member 52. In addition, lever 44 would not enter the inner pocket formed by side wall 40 and partial wall 42, but instead may obstruct the same.

Except for certain modifications, the embodiment of FIGS. 6–10 is otherwise substantially the same as the embodiment of FIGS. 1–5. Accordingly, identical or substantially identical elements bear the same reference numerals, and the description and operation thereof can be assumed to be the same as already set forth and will not be repeated. Similarly, the variations described in connection with the embodiment of FIGS. 1–5 are equally applicable to the embodiment of FIGS. 6–10 and the description thereof also will not be repeated.

Referring to FIGS. 6–9 together, the modified tamper mechanism comprises head 150 and support member 152 which is secured at its lower extremity to spring-biased lever 144. Spring-biased lever 144 is pivotally mounted by means of pin 145 on lugs 146 and 147 of windscreen 136. As best shown in FIG. 7, the lower extremity of support member 152 is brazed or welded to a central portion of the transverse surface of lever 144, but may be secured thereto by other means also, e.g., adhered thereto, held thereon by fastener means, or the like. Alternatively, lever 144, support member 152 and head 150 may be integrally formed.

The cam surfaces of lever 144 coact with the inner wall surfaces of the cover. In the embodiment of FIGS. 6–9, the inner coacting wall surfaces comprise a pocket-like insert secured to an inner surface of the cover. It comprises back wall 141, side walls 142A and 142B and a bifurcated transverse depending front wall having wall portions 143A and 143B. Wall portions 143A and 143B are spaced so as to accommodate support member 152 when the cover is closed, as depicted in FIG. 9. For convenience and economy of manufacture, wall portions 143A and 143B may simply be extensions of side walls 142A and 142B, respectively, which extensions are bent 90°, as depicted.

Lever 144 has a greater transverse width than support member 152 whereby the marginal portions of the cam surface of the lever will contact wall portions 143A and 143B. Thus, even though tamper support member 152 passes between wall portions 143A and 143B, the marginal portions of the cam surface of the lever will make contact with the wall portions and thereby provide the resilient cam action which biases the cover in the closed position. To accommodate the greater width of lever 144, as compared with that of lever 44 in the embodiment of FIGS. 1–5, opposed lugs 146 and 146 on windscreen 136 may be wider spaced, and pivot pin 145 may be lengthened correspondingly.

Referring to FIG. 10, the alternative inner wall structure for engagement with spring-biased lever 144 comprises back wall 241, bottom wall 242, which may optionally be spaced from the adjacent wall of the cover 12, depending on the geometry of the structure, and bifurcated wall portions 243A and 243B. As those skilled in the art will recognize, the inner wall structure of FIG. 10 may advantageously be substituted for that shown in the embodiment of FIGS. 6, 8 and 9. The choice is primarily a matter of manufacturing convenience and associated cost considerations.

For example, the alternative inner wall structure of FIG. 10 may be simply fabricated from a strip which is bent into a generally U-shaped configuration and spot-welded into place, as depicted. Manifestly, a functional equivalent of the inner wall structures of FIGS. 6 and 8–10 could be simply formed from depending wall 42 of FIGS. 2 and 3 by providing a central slot therein having sufficient space to accommodate the support member of the tamper mechanism. Other equivalents will be apparent to those skilled in the art.

As is apparent from the drawings of both embodiments, the user merely needs to snap open the cover 12 of the combination lighter and tamper with a single movement, using only one hand both to hold the lighter-tamper combination and to open the cover, thereby exposing both the lighter mechanism and the tamping mechanism. By gripping the outer hollow member 18, and optionally the open cover 12, he can carry out the tamping function without touching the tamper head or otherwise exposing his fingers to the heat or tobacco residues. When the cover is snapped shut, the tamping mechanism as well as the lighter mechanism is completely enclosed whereby any residues or the like cannot stain, snag or otherwise soil clothing. In addition, the user's fingers and clothing are not exposed to the heat which may build up in the tamping head as a result of contact with hot tobacco. Any embers which may be entrained on the tamping mechanism are completely enclosed once the cover is shut and are quickly extinguished from lack of oxygen.

A unique aspect of the present construction is that the tamper mechanism is compatible with the present construction of popular type lighters and takes advantage of mechanical parts and functions already available for one purpose to make possible a distinct and separate purpose. Thus, for example, as is apparent from the specific embodiment of FIGS. 1–5, a conventional lighter, such as the well-known Zippo brand lighter, can be converted to the unique combination lighter and tamper of the present invention by simply replacing or modifying one part, namely, the lever, and substituting the combination shown in FIG. 5. This combination would present essentially the same cam surface to leaf spring 48 as in the conventional lighter. Without the tamper it is a conventional lighter. With the tamper it is the combination of the present invention wherein the same lever action controls both the cover and the exposed position and the stored position of the tamper.

A manufacturer is thus in a position to produce two versions of the same lighter having a great commonality of parts, one for the cigarette smoker who has no need for a tamper, and another for the pipe or cigar smoker who may desire a built-in tamper, blade or pick with his lighter. In short, the combination of the present invention is an all-in-one device which can be actuated with a single and familiar movement so as to provide a built-in tamper or the like, which is automatically exposed and disposed in a desirable tamping position.

From the above description it is apparent that the objects of the present invention have been achieved. While only preferred embodiments, including the best mode, have been set forth, alternative embodiments and various modifications will be apparent from the above description to those skilled in the art. These and other alternatives are considered equivalents and within the spirit and scope of the present invention.

Having described the invention, what is claimed is:

1. In a pyrophoric lighter having a hinged cover operatively controlling a spring-biased, pivotally-mounted lever means, said lever means alternately biasing the hinged cover in a closed position when said lever means is in a first biased position or holding the cover in an open position to expose the lighter mechanism when said lever means is rotated to a second biased position, the improvement which comprises tamper means secured to and rotatable with said lever means, said tamper means comprising a tamping head at one extremity of an elongated support member, said support member being secured adjacent the other extremity thereof to said lever means so as to rotate therewith, said head and support member being configured and disposed so as to be completely enclosed within said cover when said lever means is in said first biased position and to be exposable for tamping purposes when said lever means is in said second biased position.

2. The pyrophoric lighter of claim 1, wherein said lighter mechanism is disposed interior of opposed margins of the lighter covered by said cover, and said support member intermediate the head and the extremity secured to said lever means is configured to bridge said lighter mechanism.

3. The pyrophoric lighter of claim 1, wherein said support member has a sharpened portion disposed for cutting purposes when said hinged cover is in the open position.

4. The pyrophoric lighter of claim 1, wherein said tamping head has a pointed portion whereby said tamping head may be used as a pick when said hinged cover is in the open position.

5. The pyrophoric lighter of claim 1, wherein said lever means is operatively controlled, at least in part, by contact with a transverse inner wall within said hinged cover.

6. The pyrophoric lighter of claim 5, wherein said inner wall is bifurcated to provide clearance for said elonaged support member when said hinged cover is in the closed position.

7. A combination lighter and tamper, said lighter comprising a lighter mechanism having a hinged cover operatively controlling a spring-biased, pivotally-mounted lever means, said lever means alternately biasing the hinged cover in a closed position when said lever means is in a first biased position or holding the cover in an open position to expose the lighter mechanism when said lever means is rotated to a second biased position, the lighter mechanism being disposed interior of the cover in the closed position; said tamper comprising a tamping head at one extremity of an elongated support member, said support member being secured adjacent the other extremity thereof to said lever means so as to rotate therewith, said head and support member being configured and disposed so as to be completely enclosed within said cover when said lever means is in the first biased position and to be exposable for tamping purposes when said lever means is in the second biased position, said support member intermediate the head and the extremity secured to said lever means being configured to bridge said lighter mechanism when said cover is in the closed position.

* * * * *